US011653774B1

(12) United States Patent
Hu

(10) Patent No.: US 11,653,774 B1
(45) Date of Patent: May 23, 2023

(54) TOOL HANGER

(71) Applicant: Chao-Ming Hu, Taichung (TW)

(72) Inventor: Chao-Ming Hu, Taichung (TW)

( * ) Notice: Subject to any disclaimer, the term of this patent is extended or adjusted under 35 U.S.C. 154(b) by 0 days.

(21) Appl. No.: 17/868,290

(22) Filed: Jul. 19, 2022

(51) Int. Cl.

| | |
|---|---|
| ***A47F 5/00*** | (2006.01) |
| ***B25H 3/04*** | (2006.01) |
| ***A47F 5/08*** | (2006.01) |
| ***E05B 73/00*** | (2006.01) |

(52) U.S. Cl.
CPC ..... *A47F 5/0006* (2013.01); *A47F 5/0861* (2013.01); *B25H 3/04* (2013.01); *E05B 73/00* (2013.01)

(58) Field of Classification Search
CPC ..... A47F 5/0006; A47F 5/0861; B25H 3/04; B25H 3/003; E05B 73/00; E05B 73/0017; E05B 73/0047; E05B 73/0064; B65D 73/0064
USPC ..... 211/70.6, 4, 69; 248/551; 206/349, 372, 206/376, 378, 379
See application file for complete search history.

(56) References Cited

U.S. PATENT DOCUMENTS 5,967,340 A * 10/1999 Kao ..... B25H 3/04 294/146
6,079,559 A * 6/2000 Lee ..... A47F 5/0006 206/443
6,126,004 A * 10/2000 Ling ..... B25H 3/04 206/378
6,409,015 B1 * 6/2002 Hu ..... B65D 73/0064 206/349
6,415,933 B1 * 7/2002 Kao ..... B65D 73/0064 206/378
6,508,360 B1 * 1/2003 Chen ..... B25H 3/003 206/349
6,698,600 B1 * 3/2004 Lee ..... B25H 3/003 206/378
6,902,058 B1 * 6/2005 Chang ..... B65D 73/0064 206/378
7,210,663 B2 * 5/2007 Wheeler ..... B65D 73/0064 206/349
7,565,973 B2 * 7/2009 Chang ..... B65D 73/0064 248/689
7,648,029 B2 * 1/2010 Chen ..... A47F 5/0006 211/70.6
8,376,153 B1 * 2/2013 Lee ..... B25H 3/003 211/70.6

(Continued)

*Primary Examiner* — Jennifer E. Novosad
(74) *Attorney, Agent, or Firm* — Muncy, Geissler, Olds & Lowe, P.C.

(57) ABSTRACT

A tool hanger including: a base; seat portions, disposed on the base for connection of a tool, including a projection for engagement within a positioning hole of the tool; an anti-theft member, including limitation portions and at least one connection portion which is connected between the limitation portions by a connecting section and inserted in through holes and insertion holes of the seat portions, the limitation portions being relatively rotatable; when the limitation portions are located in a release position, the projection is radially movable and the tool is axially movable; when the limitation portions are located in a locking position, the limitation portions block the projection from radially moving and the tool is axially non-movable; and the connection portion is broken and separated from the at least one connection portion as the limitation portions are rotated.

10 Claims, 9 Drawing Sheets

(56) References Cited

U.S. PATENT DOCUMENTS

| | | | | |
|---|---|---|---|---|
| 8,381,905 | B1 * | 2/2013 | Kao | B25H 3/003 206/378 |
| 8,556,075 | B1 * | 10/2013 | Ou | B65D 73/0064 206/378 |
| 8,573,413 | B2 * | 11/2013 | Sh | B25H 3/04 211/70.6 |
| 8,800,767 | B2 * | 8/2014 | Wang | B25H 3/00 206/378 |
| 9,126,739 | B2 * | 9/2015 | Chao-Ming | B25H 3/003 |
| 9,180,590 | B1 * | 11/2015 | Ou | B65D 71/00 |
| 9,247,832 | B2 * | 2/2016 | Chang | A47F 5/0823 |
| 9,528,303 | B1 * | 12/2016 | Lai | A47F 5/0861 |
| 9,572,437 | B1 * | 2/2017 | Ou | B25H 3/003 |
| 10,023,374 | B2 * | 7/2018 | Ou | B25H 3/003 |
| 10,173,314 | B1 * | 1/2019 | Lai | A47F 5/0006 |
| 10,737,858 | B1 * | 8/2020 | Hsu | B65D 73/0064 |
| 10,906,714 | B2 * | 2/2021 | Chen | B25H 3/003 |
| 2003/0141211 | A1 * | 7/2003 | Tsai | B25H 3/003 206/378 |
| 2006/0086636 | A1 * | 4/2006 | Kuo | B65D 73/0064 206/349 |
| 2009/0145865 | A1 * | 6/2009 | Yu | B25H 3/003 700/95 |
| 2012/0091074 | A1 * | 4/2012 | Chang | B65D 73/0014 211/4 |
| 2018/0310728 | A1 * | 11/2018 | Chen | A47F 7/0021 |
| 2019/0366531 | A1 * | 12/2019 | Hu | B25H 3/04 |

* cited by examiner

TOOL HANGER

BACKGROUND OF THE INVENTION

Field of the Invention

The present invention relates to a tool hanger.

Description of the Prior Art

Generally, a tool hanger is used to carry one or more tools, which facilitates storage, portability, and exhibition. In order to prevent people from stealing the tools, the tool hanger tool with anti-theft function is used.

The conventional tool hanger includes a board, a plurality of seats and positioning members, the plurality of seats are disposed on the board, each of the seats includes a first fitting portion and a second fitting portion, and the a first fitting portion and the second fitting portion are separately arranged with an interval. Each of the positioning members includes a plurality of positioning units and is snapped to the board by two snap portions. Each of the plurality of positioning units is located within the interval to block and elastically contract the first fitting portion and the second fitting portion to prevent the tools (such as sockets) on the first fitting portion and the second fitting portion from being taken out. However, it has to cut off all the positioning members to take out the tools from the tool hanger, and it cannot allow to optionally unlock any single one of the plurality of seats, so the conventional tool hanger cannot be reused.

The present invention is, therefore, arisen to obviate or at least mitigate the above-mentioned disadvantages.

SUMMARY OF THE INVENTION

The main object of the present invention is to provide a tool hanger which provides functions of anti-theft, display and storage.

To achieve the above and other objects, a tool hanger is provided, including: a base, including a plurality of through holes; at least two seat portions, disposed on the base, each of the at least two seat portions including a column extending in an axial direction, the column being configured for connection of a tool, the column including a projection and an insertion hole, the projection being configured for being engaged within a positioning hole of the tool; and an anti-theft member, including at least two limitation portions and at least one connection portion, the at least one connection portion being connected to and between the at least two limitation portions, each of the at least two limitation portions including an assembling portion, each of the at least two limitation portions being inserted axially in one of the plurality of through holes and the insertion hole of one of the at least two seat portions, the assembling portion of each of the at least two limitation portions being configured for connection of a driving tool, one of the at least two limitation portions being rotatable about an axis between a locking position and a release position relative to another one of the at least two limitation portions, the axis extending in the axial direction; wherein, when each of the at least two limitation portions is located in the release position, the projection of one of the at least two seat portions is radially movable, the tool is movable in the axial direction relative to the column; when each of the at least two limitation portions is located in the locking position, each of the at least two limitation portions blocks the projection of one of the at least two seat portions from radially moving toward the insertion hole so that the tool is positioned to the column of one of the at least two seat portions and is non-movable in the axial direction relative to the column; wherein each of the at least two limitation portions is connected and positioned to the at least one connection portion by a connecting section, and the connection portion is broken and separated from the at least one connection portion as each of the at least two limitation portions are rotated.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
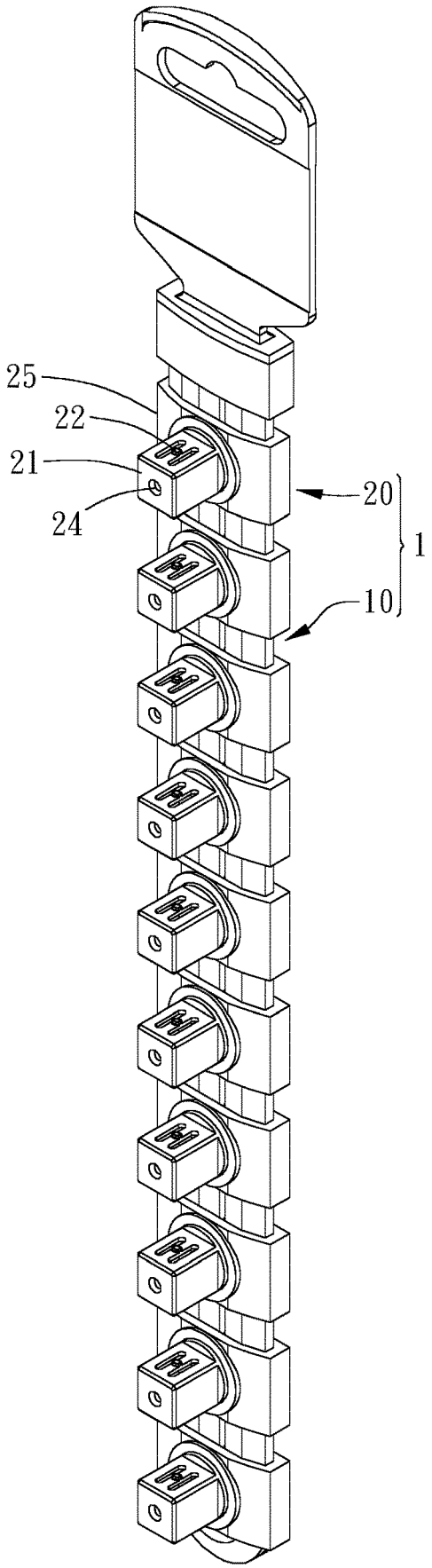
FIG. 1 is a stereogram of a preferable embodiment of the present invention.
Figure 2:
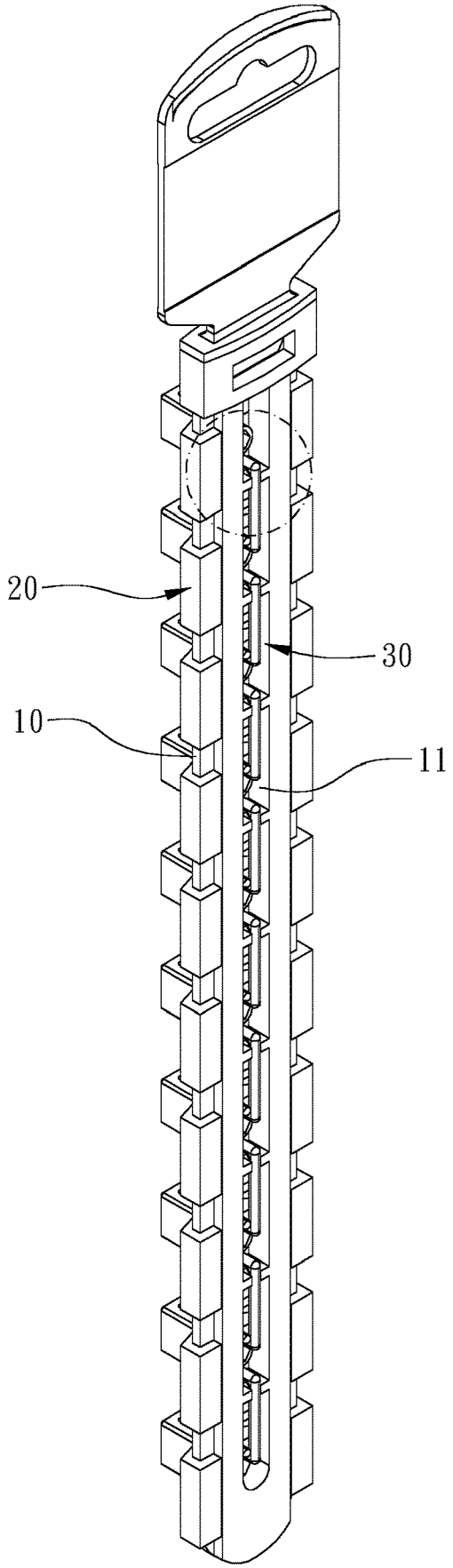
FIG. 2 is another stereogram of a preferable embodiment of the present invention.
Figure 3:
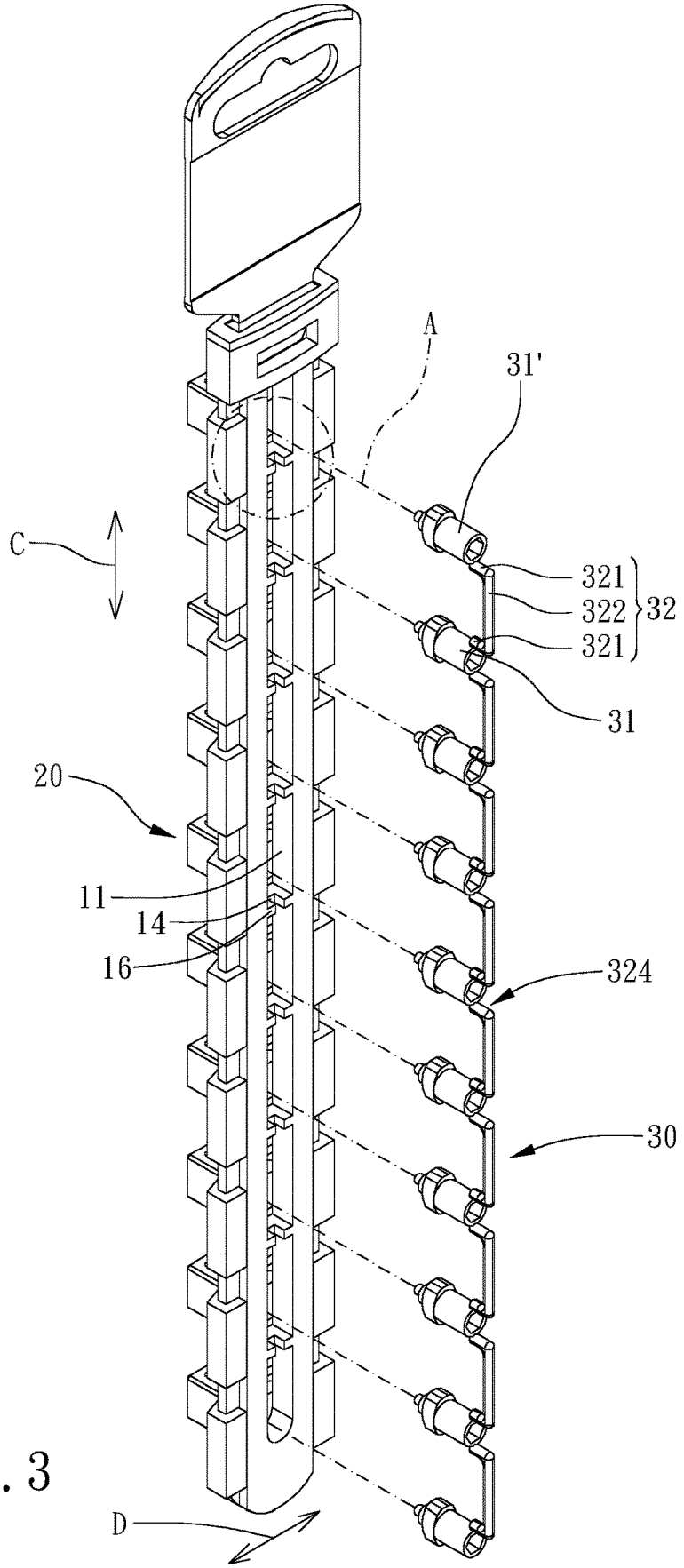
FIG. 3 is a breakdown drawing of a preferable embodiment of the present invention.
Figure 4:
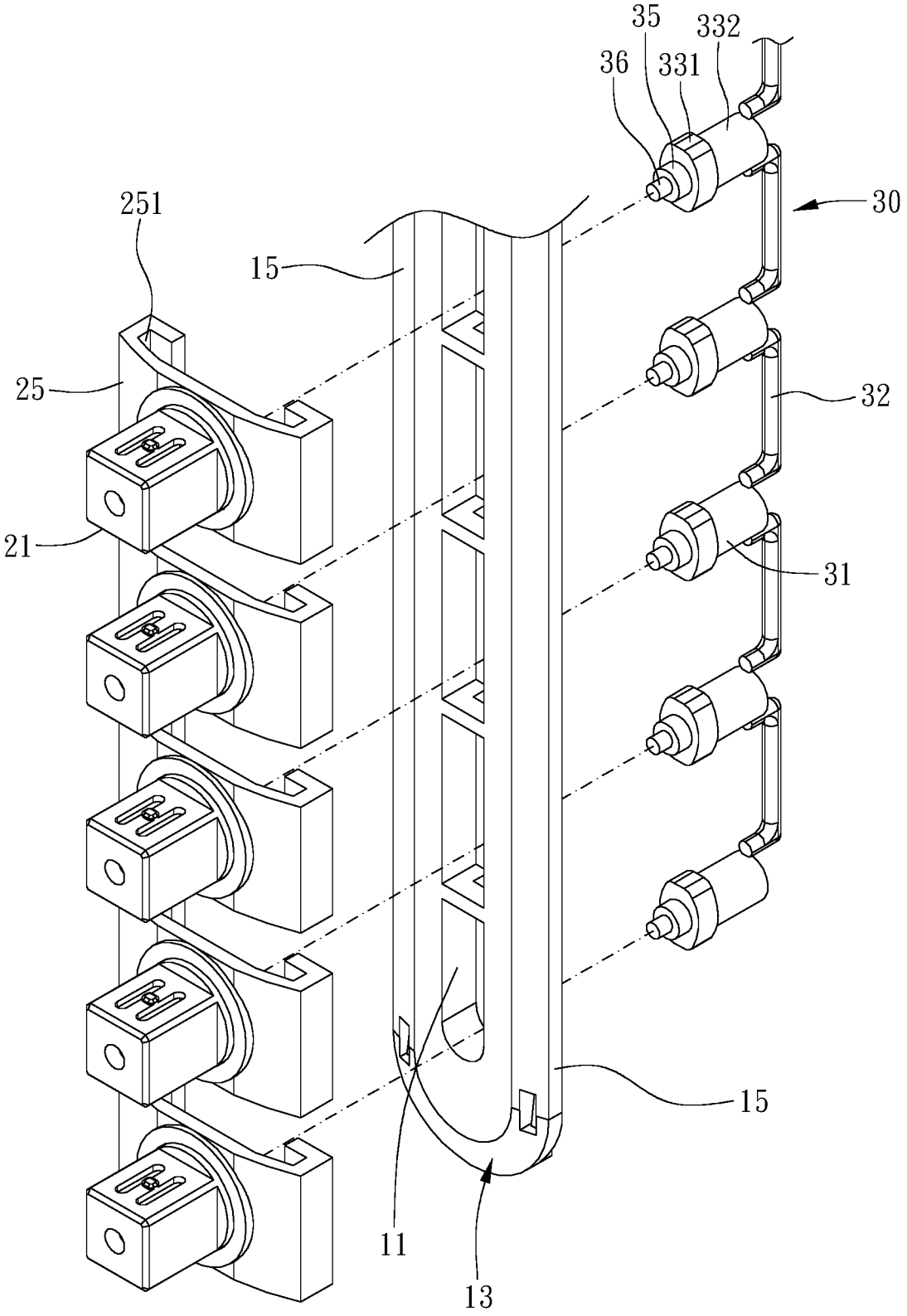
FIG. 4 is another breakdown drawing of a preferable embodiment of the present invention.
Figure 5:
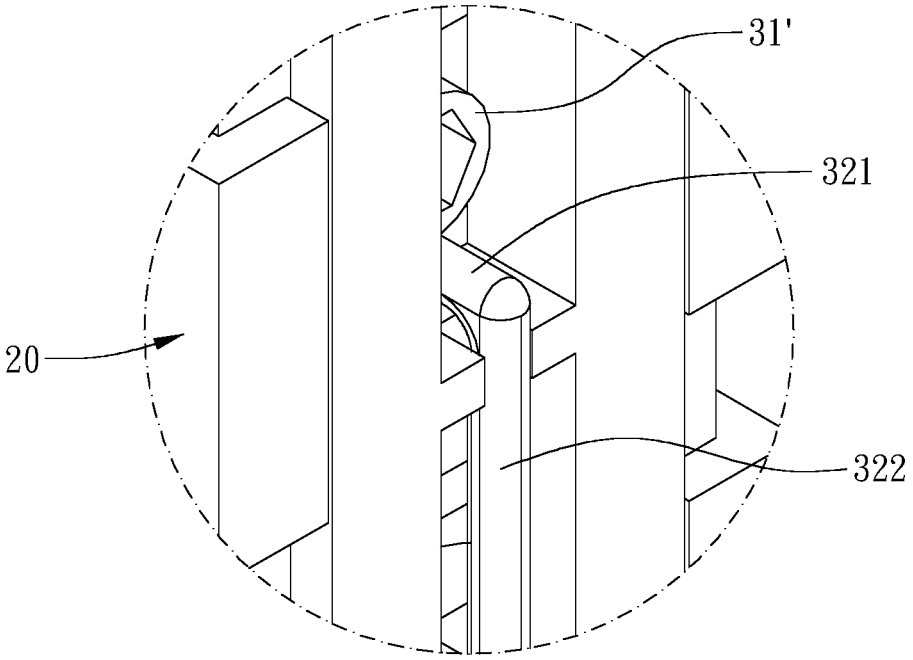
FIG. 5 is an enlargement of FIG. 2.
Figure 6:
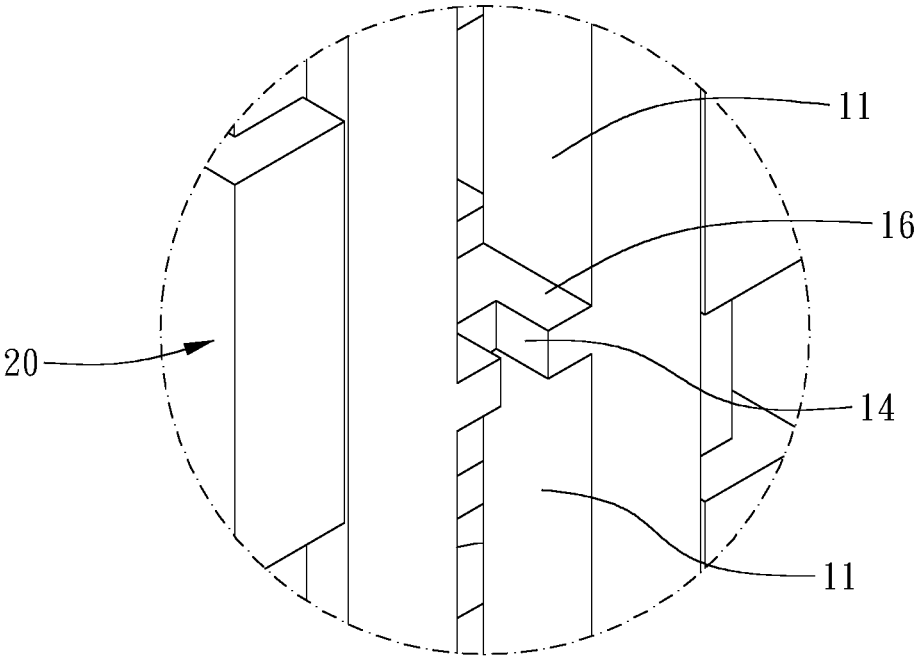
FIG. 6 is an enlargement of FIG. 3.
Figure 7:
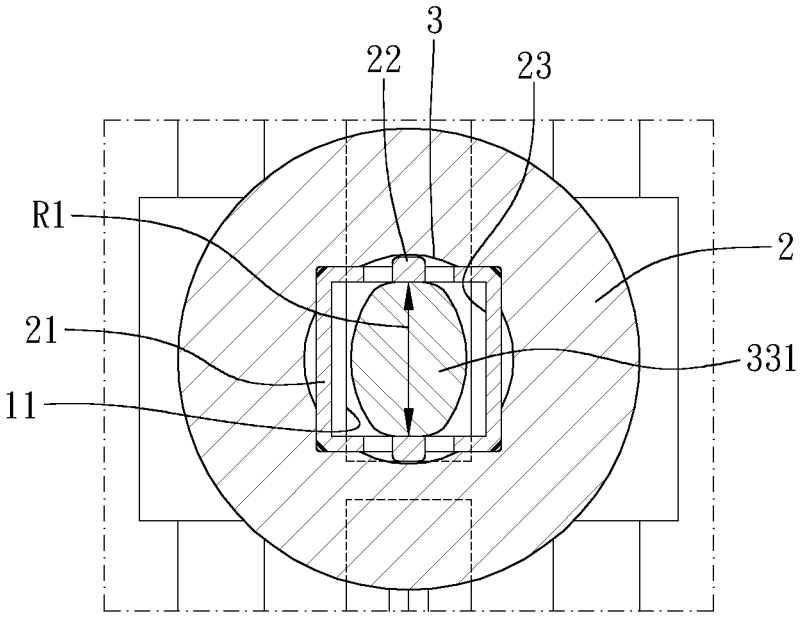
FIG. 7 is a cross-sectional view showing a limitation portion located in a locking position according to a preferable embodiment of the present invention.
Figure 8:
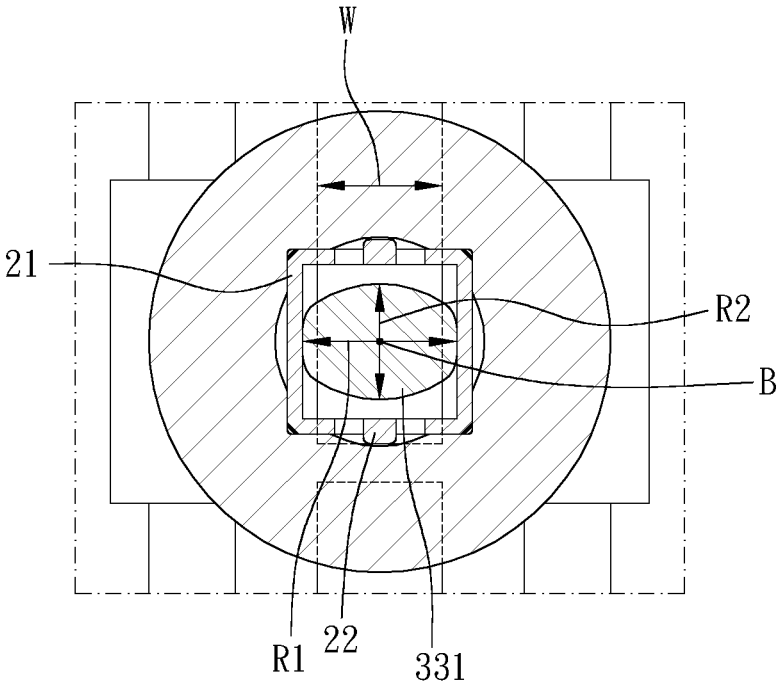
FIG. 8 is a cross-sectional view showing the limitation portion located in a release position according to a preferable embodiment of the present invention.
Figure 9:
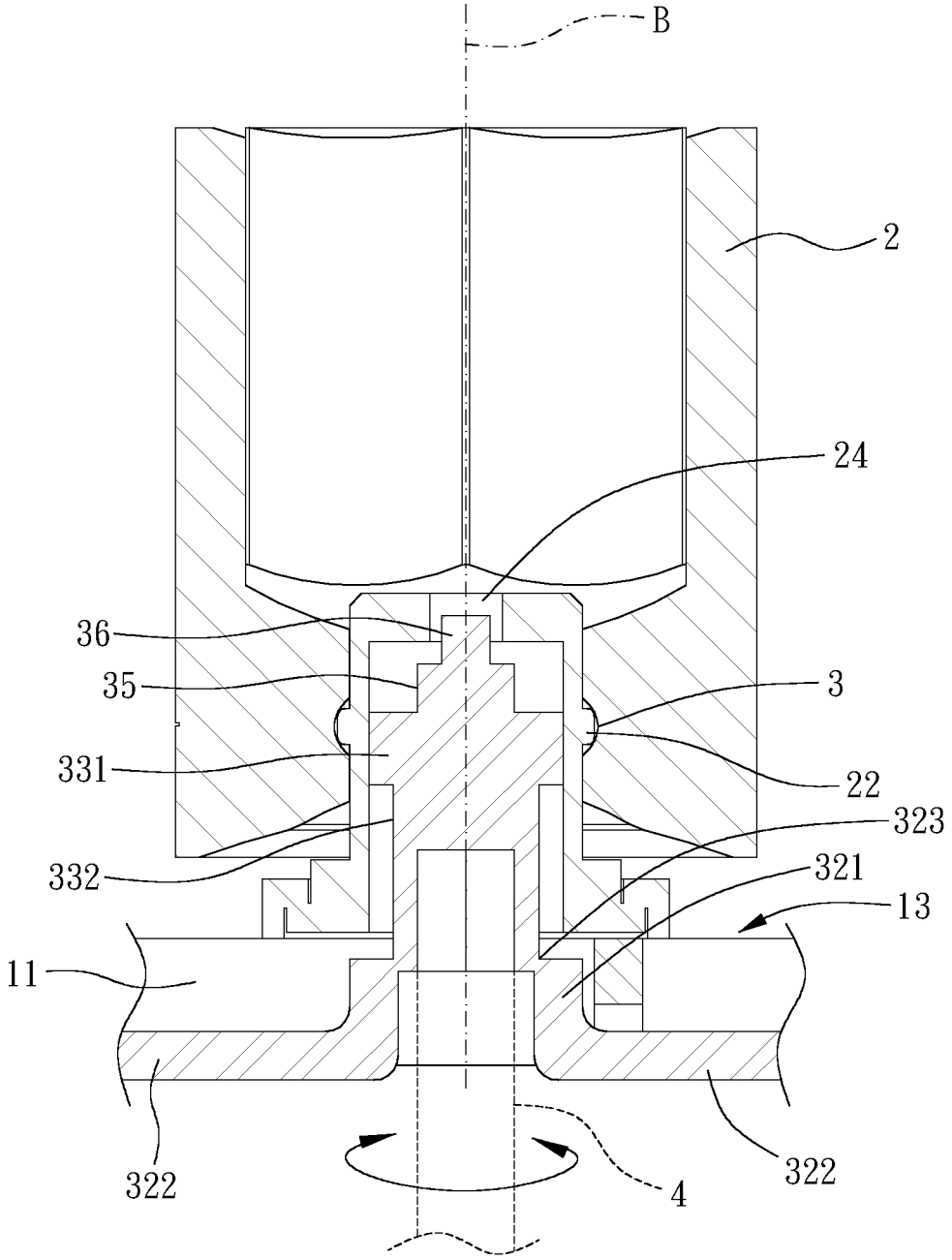
FIG. 9 is a drawing showing operation of a preferable embodiment of the present invention.
Figure 10:
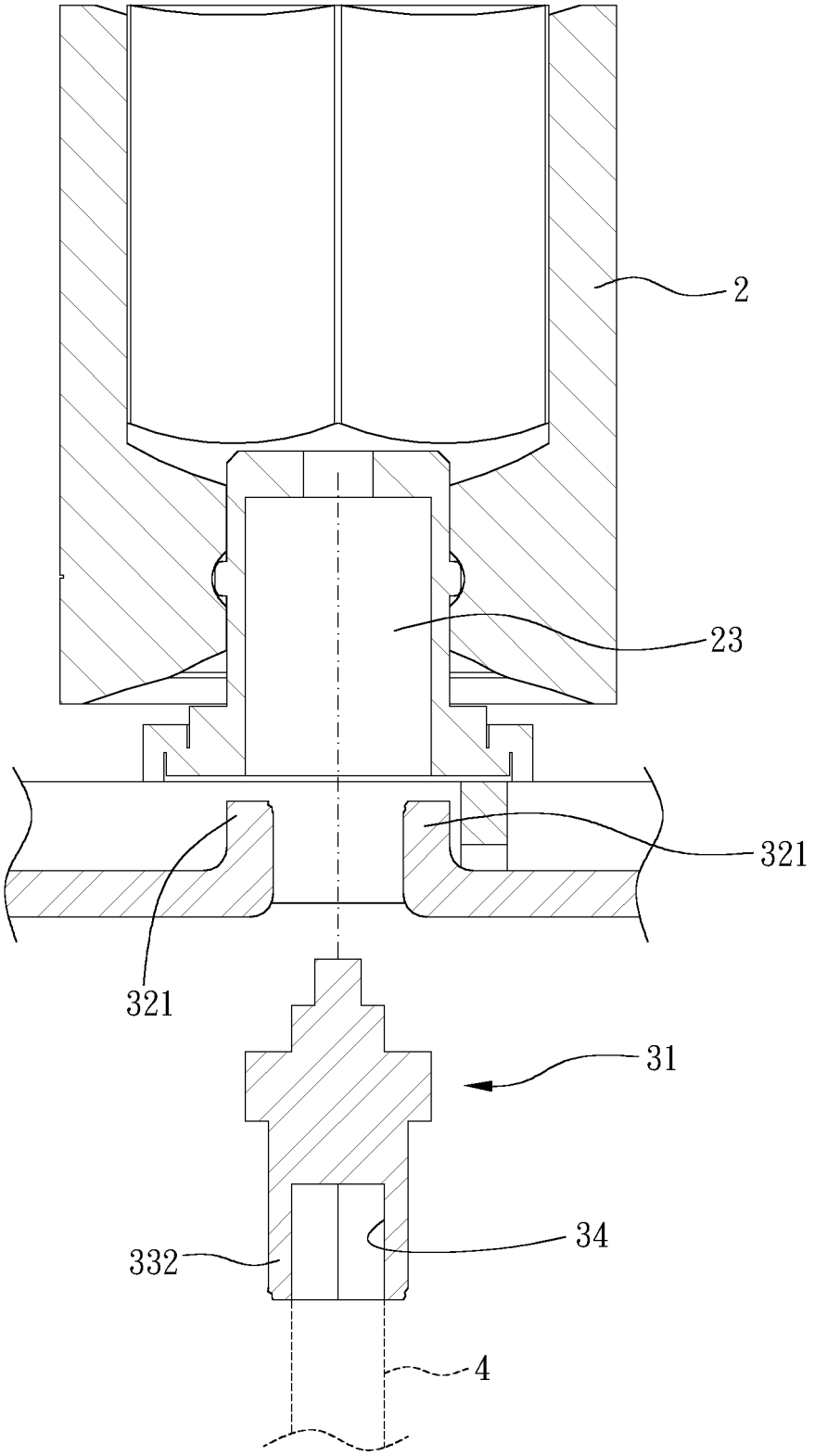
FIG. 10 is a drawing showing the limitation portion detached according to a preferable embodiment of the present invention.
Figure 11:
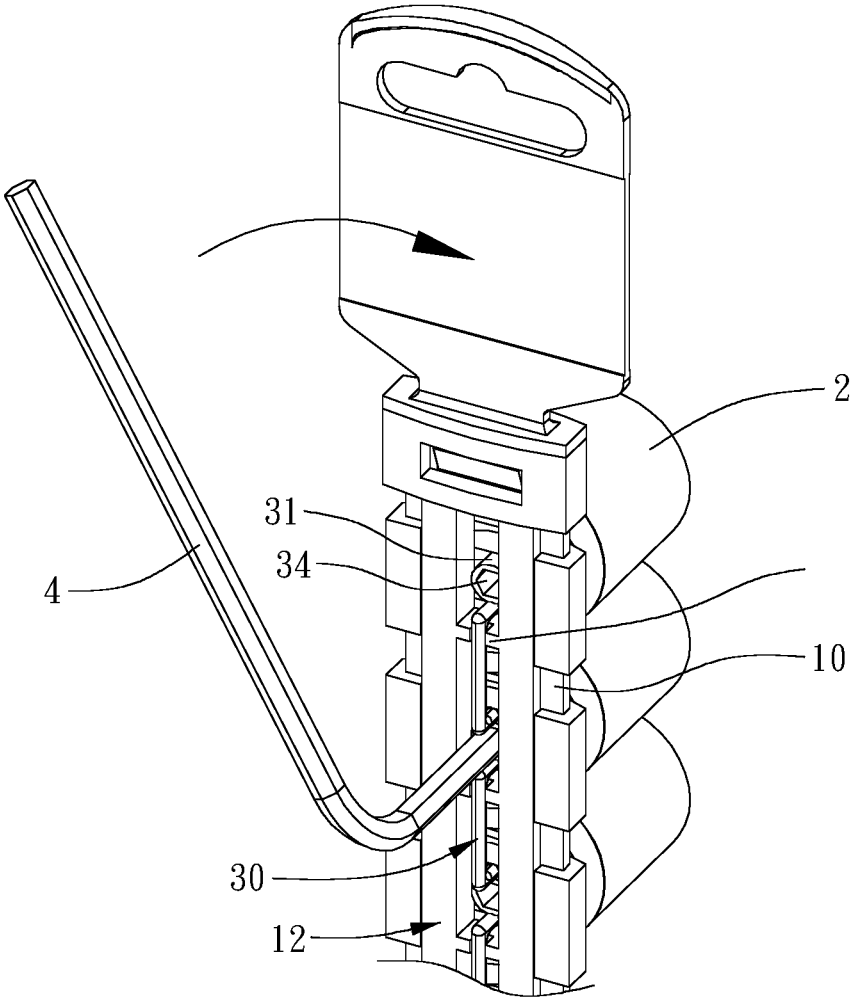
FIG. 11 is another drawing showing operation of a preferable embodiment of the present invention.

Please refer to FIGS. 1 to 11 for a preferable embodiment of the present invention. A tool hanger 1 of the present invention includes a base 10, at least two seat portions 20 and an anti-theft member 30.

The base 10 includes a plurality of through holes 11; the at least two seat portions 20 are disposed on the base 10, each of the at least two seat portions 20 includes a column 21 extending in an axial direction A, the column 21 is configured for connection of a tool 2, the column 21 includes a projection 22 and an insertion hole 23, and the projection 22 is configured for being engaged within a positioning hole 3 of the tool 2; the anti-theft member 30 includes at least two limitation portions 31, 31' and at least one connection portion 32, the at least one connection portion 32 is connected to and between the at least two limitation portions 31, 31', each of the at least two limitation portions 31, 31' includes an assembling portion 34, each of the at least two limitation portions 31, 31' is inserted axially in one of the plurality of through holes 11 and the insertion hole 23 of one of the at least two seat portions 20, the assembling portion 34 of each of the at least two limitation portions 31, 31' is configured for connection of a driving tool 4, one of the at least two limitation portions 31, 31' is rotatable about an axis B between a locking position (FIG. 7) and a release position (FIG. 8) relative to another one of the at least two limitation portions, and the axis B extends in the axial direction A; when each of the at least two limitation portions 31, 31' is located in the release position, the projection 22 of one of the at least two seat portions 20 is radially movable, the tool 2 is movable in the axial direction A relative to the column 21; when each of the at least two limitation portions 31, 31' is located in the locking position, each of the at least two limitation portions 31, 31' blocks the projection 22 of one of the at least two seat portions 20 from radially moving toward the insertion hole 23 so that the tool 2 is positioned to the column 21 of one of the at least two seat portions 21 and is non-movable in the axial direction A relative to the column 21. As such, it provides functions of anti-theft, display and storage, any of the limitation portions 31, 31' can be released by rotation to unlock one of the at least two seat portions 20 to take out the tool 2 without removing the anti-theft member 30; moreover, without removing the anti-theft member 30, the tool 2 can be taken out as any of the at least two seat portions 20 is released, and the tool 2 cannot be taken out as any of the at least two seat portions 20 is locked, so that it can be reused.

In this embodiment, the assembling portion 34 is a hexagonal hole; in other embodiments, the assembling portion may be a hexagonal head.

Specifically, the projection 22 includes an elastic sheet and a bump disposed on the elastic sheet, and the elastic sheet can pivot relative to the column 21.

Each of the at least two limitation portions 31, 31' includes a large outer diameter R1 transverse to the axis B and a small outer diameter R2 transverse to the axis B and the large outer diameter R1; when each of the at least two limitation portions 31, 31' is located in the release position, the small outer diameter R2 corresponds to the projection 22; and when the limitation portion 31, 31' is located in the locking position, the large outer diameter R1 blocks the projection 22, so that the projection 22 of the seat portion 20 can be locked or released by rotating any of the limitation portions 31, 31'. Preferably, the base 10 extends in an extension direction C, the plurality of through holes 11 are arranged in the extension direction C and extend through the base 10 in the axial direction A, the base 10 defines a width direction D, the extension direction C, the width direction D and the axial direction A are transverse to one another, and each of the plurality of through holes 11 has a width dimension W the width direction D smaller than the large outer diameter R1 of each of the at least two limitation portions 31, 31' and larger than or equal to the small outer diameter R2 of each of the at least two limitation portions 31, 31'. When the large outer diameter R1 of each of the at least two limitation portions 31, 31' is transverse to the extension direction C, each of the at least two limitation portions 31, 31' is not detachable from the base 10.

Each of the at least two limitation portions 31, 31' includes a blocking section 331 and a base section 332, the blocking section 331 and the base section 332 are arranged in the axial direction A, the blocking section 331 includes the large outer diameter R1 and the small outer diameter R2, the base section 332 is rotatable about the axial direction A within one of the plurality of through holes 11, and the blocking section 331 is located outside one of the plurality of through holes 11 and inserted in the insertion hole 23 of one of the at least two seat portions 20. Preferably, the column 21 of each of the at least two seat portions 20 further includes a perforation 24 in communication with the insertion hole 23, each of the at least two limitation portions 31, 31' further includes a reinforcement section 35 and a shaft section 36, the reinforcement section 35 is disposed between the shaft section 36 and the blocking section 331 in the axial direction A, and the shaft section 36 is rotatably inserted in the perforation 24 so that each of the at least two limitation portions 31, 31' can rotate stably and the shaft section 36 is not easy to be damaged.

The base 10 further includes a bottom portion 12 and a top portion 13, each of the plurality of through holes 11 is disposed through the bottom portion 12 and the top portion 13 in the axial direction A, the bottom portion 12 includes at least one engaging slot 14, each of the at least one engaging slot 14 in communication with and between two of the plurality of through holes 11, in the axial direction A the at least one connection portion 32 is engaged within the at least one engaging slot 14, and each of the at least one engaging slot 14 is at least open toward the at least one connection portion 32 in the axial direction A. Preferably, each of the at least one connection portion 32 is U-shaped, each of the at least one connection portion 32 includes two arm sections 321 and a middle section 322, the middle section 322 is connected with and between the two arm sections 321, each of the two arm sections 321 extends in the axial direction A, and the middle section 322 of each of the at least one connection portion 32 is engaged within the at least one engaging slot 14. The base 10 further includes at least one separator 16, each of the at least one separator 16 is disposed between two of the plurality of through holes 11, and the at least one separator 16 includes the at least one engaging slot 14. Preferably, each of the two arm sections 321 is connected to the base section 332, an end portion 324 of each of the two arm sections 321 is protrusive beyond the base section 332 in a direction away from the blocking section 331, and the middle section 322 is connected to the end portion 324 of each of the two arm sections 321. Specifically, each of the at least two limitation portions 31, 31' is connected and positioned to the at least one connection portion 32 by a connecting section 323, and the connecting section 323 is broken and separated from the at least one connection portion 32 as each of the at least two limitation portions 31, 31' are rotated. The connecting section 323 is preferably thin. Each of the two arm sections 321 and the base section 332 are connected to each other by the at least one connection portion 32. When each of the at least two limitation portions 31, 31' rotates, the inner wall of the at least one engaging slot 14 blocks the at least one connection portion 32 from rotating freely so that one of the at least two limitation portions 31, 31' is rotatable relative to another one of the at least two limitation portions 31, 31', which is easy to break the at least one connection portion 32. In this embodiment, each of the at least two limitation portions 31, 31' and each of the at least one connection portion 32 are integrally formed of one piece. Each of the at least one connection portion 32 has an outer dimension smaller than an outer dimension of each of the at least two limitation portions 31, 31'. Specifically, the base section 332 of each of the at least two limitation portions 31, 31' has an outer dimension larger than an outer dimension of each of the two arm sections 321, which is conducive to easy disconnection of the base section 332 from each of the two arm sections 321.

The base 10 further includes two wings 15, each of the at least two seat portions 20 further includes a saddle portion 25, the column 21 is connected to the saddle portion 25 in the axial direction A, the saddle portion 25 is saddle on the base 10, an inner side of the saddle portion 25 includes two grooves 251, each of the two wings 15 extends within one of the two grooves 251, the plurality of through holes 11 are located between the two wings 15, and each of the at least two seat portions 20 is slidable relative to the base 10.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool hanger, including:

a base, including a plurality of through holes;

at least two seat portions, disposed on the base, each of the at least two seat portions including a column extending in an axial direction, the column being configured for connection with a tool, the column including a projection and an insertion hole, the projection being configured for being engaged within a positioning hole of the tool; and an anti-theft member, including at least two limitation portions and at least one connection portion, the at least one connection portion being connected to and between the at least two limitation portions, each of the at least two limitation portions including an assembling portion, each of the at least two limitation portions being inserted axially in one of the plurality of through holes and the insertion hole of one of the at least two seat portions, the assembling portion of each of the at least two limitation portions being configured for connection of a driving tool, one of the at least two limitation portions being rotatable about an axis between a locking position and a release position relative to another one of the at least two limitation portions, the axis extending in the axial direction;

wherein, when each of the at least two limitation portions is located in the release position, the projection of one of the at least two seat portions is radially movable, the tool is movable in the axial direction relative to the column; when each of the at least two limitation portions is located in the locking position, each of the at least two limitation portions blocks the projection of one of the at least two seat portions from radially moving toward the insertion hole so that the tool is positioned to the column of one of the at least two seat portions and is non-movable in the axial direction relative to the column;

wherein each of the at least two limitation portions is connected and positioned to the at least one connection portion by a connecting section, and the connection portion is broken and separated from the at least one connection portion as each of the at least two limitation portions are rotated.

2. The tool hanger of claim 1, wherein each of the at least two limitation portions includes a large outer diameter transverse to the axis and a small outer diameter transverse to the axis and the large outer diameter; when each of the at least two limitation portions is located in the release position, the small outer diameter corresponds to the projection; and when the limitation portion is located in the locking position, the large outer diameter blocks the projection.

3. The tool hanger of claim 2, wherein the base extends in an extension direction, the plurality of through holes are arranged in the extension direction and extend through the base in the axial direction, the base defines a width direction; the extension direction, the width direction and the axial direction are transverse to one another, and each of the plurality of through holes has a width dimension in the width direction smaller than the large outer diameter of each of the at least two limitation portions and larger than or equal to the small outer diameter of each of the at least two limitation portions.

4. The tool hanger of claim 2, wherein each of the at least two limitation portions includes a blocking section and a base section, the blocking section and the base section are arranged in the axial direction, the blocking section includes the large outer diameter and the small outer diameter, the base section is rotatable about the axial direction within one of the plurality of through holes, and the blocking section is located outside one of the plurality of through holes and inserted in the insertion hole of one of the at least two seat portions.

5. The tool hanger of claim 4, wherein the column of each of the at least two seat portions further includes a perforation in communication with the insertion hole, each of the at least two limitation portions further includes a reinforcement section and a shaft section, the reinforcement section is disposed between the shaft section and the blocking section in the axial direction, and the shaft section is rotatably inserted in the perforation.

6. The tool hanger of claim 5, wherein the base extends in an extension direction, the plurality of through holes are arranged in the extension direction and extend through the base in the axial direction, the base defines a width direction; the extension direction, the width direction and the axial direction are transverse to one another, and each of the plurality of through holes has a width dimension in the width direction smaller than the large outer diameter of each of the at least two limitation portions and larger than or equal to the small outer diameter of each of the at least two limitation portions; the base further includes a bottom portion and a top portion, each of the plurality of through holes is disposed through the bottom portion and the top portion in the axial direction, the bottom portion includes at least one engaging slot, each of the at least one engaging slot is in communication with and between two of the plurality of through holes, in the axial direction the at least one connection portion is engaged within the at least one engaging slot, and each of the at least one engaging slot is at least open toward the at least one connection portion in the axial direction; the base further includes at least one separator, each of the at least one separator is disposed between two of the plurality of through holes, and the at least one separator includes the at least one engaging slot; each of the at least one connection portion is U-shaped, each of the at least one connection portion includes two arm sections and a middle section, the middle section is connected with and between the two arm sections, each of the two arm sections extends in the axial direction, and the middle section of each of the at least one connection portion is engaged within the at least one engaging slot; each of the two arm sections is connected to the base section, an end portion of each of the two arm sections is protrusive beyond the base section in a direction away from the blocking section, and the middle section is connected to the end portion of each of the two arm sections; each of the two arm sections and the base section are connected to each other by the at least one connection portion; the base section of each of the at least two limitation portions has an outer dimension that is larger than an outer dimension of each of the two arm sections; the base further includes two wings, each of the at least two seat portions further includes a saddle portion, the column is connected to the saddle portion in the axial direction, the saddle portion is saddled on the base, an inner side of the saddle portion includes two grooves, each of the two wings extends within one of the two grooves, and the plurality of through holes are located between the two wings.

7. The tool hanger of claim 1, wherein the base further includes a bottom portion and a top portion, each of the plurality of through holes is disposed through the bottom portion and the top portion in the axial direction, the bottom portion includes at least one engaging slot, each of the at least one engaging slot is in communication with and between two of the plurality of through holes, in the axial direction the at least one connection portion is engaged within the at least one engaging slot, and each of the at least one engaging slot is at least open toward the at least one connection portion in the axial direction.

8. The tool hanger of claim 7, wherein each of the at least one connection portion is U-shaped, each of the at least one connection portion includes two arm sections and a middle section, the middle section is connected with and between the two arm sections, each of the two arm sections extends in the axial direction, and the middle section of each of the at least one connection portion is engaged within the at least one engaging slot.

9. The tool hanger of claim 8, wherein each of the at least one connection portion has an outer dimension smaller than an outer dimension of each of the at least two limitation portions.

10. The tool hanger of claim 1, wherein the base further includes two wings, each of the at least two seat portions further includes a saddle portion, the column is connected to the saddle portion in the axial direction, the saddle portion is saddled on the base, an inner side of the saddle portion includes two grooves, each of the two wings extends within one of the two grooves, and the plurality of through holes are located between the two wings.

* * * * *